US006531515B2

(12) United States Patent
Moore, Jr. et al.

(10) Patent No.: US 6,531,515 B2
(45) Date of Patent: Mar. 11, 2003

(54) HYDROCARBON RECOVERY IN A FISCHER-TROPSCH PROCESS

(75) Inventors: Richard O. Moore, Jr., San Rafael, CA (US); Roger D. Van Gelder, Beaconsfield (GB); Grant C. Hilton, Woking (GB); Clive Jones, Reading (GB); Randall B. Pruet, Virginia Water (GB)

(73) Assignee: Chevron U.S.A. Inc., San Ramon, CA (US)

( * ) Notice: Subject to any disclaimer, the term of this patent is extended or adjusted under 35 U.S.C. 154(b) by 43 days.

(21) Appl. No.: 09/788,792

(22) Filed: Feb. 20, 2001

(65) Prior Publication Data

US 2002/0120018 A1 Aug. 29, 2002

(51) Int. Cl.[7] ..... C07C 27/00; C10G 7/00; C10G 35/00; C10G 45/00

(52) U.S. Cl. ..... 518/700; 518/702; 208/93; 208/133; 208/209

(58) Field of Search ..... 518/700, 702; 208/93, 133, 209

(56) References Cited

U.S. PATENT DOCUMENTS 3,852,207 A 12/1974 Stangeland et al.
3,904,513 A 9/1975 Fischer et al.

(List continued on next page.)

FOREIGN PATENT DOCUMENTS

| | | |
|---|---|---|
| EP | 0609079 | 8/1994 |
| JP | 59176388 A | 10/1984 |
| WO | 99/13963 | 3/1999 |
| WO | 99/37736 | 7/1999 |
| WO | 99/37741 | 7/1999 |
| WO | 00/00571 | 1/2000 |

OTHER PUBLICATIONS

Collins, C., et al., "Trends in NGL Recovery for Natural and Associated Gases", pp. 287–303 (1985) GasTech LNG/LPG Conference 84. GasTech, Ltd. of Rickmansworth, England.

(List continued on next page.)

*Primary Examiner*—Jafar F Parsa
(74) *Attorney, Agent, or Firm*—Burns, Doane, Swecker & Mathis, L.L.P.

(57) ABSTRACT

An integrated process for improved hydrocarbon recovery from a natural gas resource is disclosed. A methane-rich stream, an LPG stream and optionally a C5+ stream are isolated from a natural gas source in a first separation zone and desulfurized. The methane-rich stream is converted to syngas and subjected to hydrocarbon synthesis, for example, Fischer-Tropsch synthesis. The products from the hydrocarbon synthesis typically include a C4– fraction, a C5–C20 fraction, and a C20+ wax fraction. These fractions are isolated in a second separation zone. The C4– fraction is recycled through the first separation zone to provide methane for conversion to synthesis gas and an additional LPG fraction. The C4– fraction can be treated, for example, with hydrotreating or hydroisomerization catalysts and conditions before or after the separation. The C5–C20 fraction and the C20+ wax and heavy fraction are subjected to additional process steps, for example, hydro treatment, hydroisomerization, and/or hydrocracking. The products are sent to a third separation zone, and yield an additional C4– fraction, as well as higher molecular weight products. The additional C4– fraction can also be sent to the first separation zone and treated in an analogous fashion to the C4– fraction from the hydrocarbon synthesis. Any sulfur-containing compounds resulting from the additional processing of the hydrocarbon synthesis products (i.e., hydroconversion reactions) can be treated along with the sulfur-containing compounds in the natural gas, eliminating the need for a second sulfur-treatment plant.

25 Claims, 2 Drawing Sheets

U.S. PATENT DOCUMENTS

| | | | |
|---|---|---|---|
| 4,048,250 | A | 9/1977 | Garwood et al. |
| 4,157,294 | A | 6/1979 | Iwao et al. |
| 4,347,121 | A | 8/1982 | Mayer et al. |
| 4,401,556 | A | 8/1983 | Bezman et al. |
| 4,568,663 | A | 2/1986 | Mauldin |
| 4,810,357 | A | 3/1989 | Chester et al. |
| 4,820,402 | A | 4/1989 | Partridge et al. |
| 4,913,799 | A | 4/1990 | Gortsema et al. |
| 5,059,567 | A | 10/1991 | Linsten et al. |
| 5,073,530 | A | 12/1991 | Bezman et al. |
| 5,114,563 | A | 5/1992 | Lok et al. |
| 5,198,203 | A | 3/1993 | Kresge et al. |
| 5,246,689 | A | 9/1993 | Beck et al. |
| 5,334,368 | A | 8/1994 | Beck et al. |
| 5,852,061 | A | 12/1998 | Alexion et al. |
| 5,960,643 | A | 10/1999 | Kuechler et al. |
| 6,147,126 | A | 11/2000 | DeGeorge et al. |

OTHER PUBLICATIONS

Beck, J., et al., "A New Family of Mesoporous Molecular Sieves Prepared with Liquid Crystal Templates", *J. Am. Chem. Soc.*, 114: 10834–10843 (1992) American Chemical Society, Washington, D.C.

Kresge, C., et al., "Ordered mesoporous molecular sieves synthesized by a liquid–crystal template mechanism", *Nature* 359: 710 (1992).

Ryland, L, et al., "Cracking Catalysts," *Catalysis* vol. VII: 1–91 (1960) Reinhold Publishing Corporation, New York.

HYDROCARBON RECOVERY IN A FISCHER-TROPSCH PROCESS

FIELD OF THE INVENTION

This invention relates to improved hydrocarbon recovery from a Fischer-Tropsch process.

BACKGROUND OF THE INVENTION

Several natural gas vehicles (NGVs) have been developed in response to recent laws such as the Clean Air Act (1990) and the Energy Policy Act (1992). Because natural gas tends to burn cleanly, NGVs are a potential alternative to gasoline-powered vehicles.

There are several commercially available natural gas-based fuel formulations. The main formulations are: compressed natural gas (CNG), liquefied natural gas (LNG), and liquefied petroleum gas (LPG). In CNG technology, the gaseous (natural gas) fuel is stored at very high pressures of about 20684 kPa to 24132 kPa (3000–3500 psia). This technology is limited because the vehicles tend to have a relatively short driving range (due to low energy storage per fuel storage container volume), the high storage pressures pose a safety concern, the fuel storage containers tend to be relatively heavy; and the refueling stations tend to be relatively expensive.

LNG technology overcomes some of these limitations, in particular, by providing much more energy per unit volume, lower vehicle fuel system weight and higher fuel storage volume capability. However, the costs of the fuel storage containers are still relatively high, and the need to deliver pressurized natural gas to an engine's fuel injectors adds to the complexity and cost of the fuel delivery system.

Liquefied petroleum gas (LPG), which includes mostly propane, n-butane and/or i-butane, with small amounts of pentane, is an alternative to LNG and CNG which provides similar clean burning characteristics and which overcomes the limitations of both CNG and LNG. LPG provides higher energy storage per vessel volume than either CNG or LNG and operates at relatively low pressures (about 827 kPa (120 psia)), as compared to CNG, and at ambient temperatures. A limitation of using LPG is that the LPG supply is limited and LPG is much more expensive than LNG.

It would be advantageous to provide new methods for preparing LPG. The present invention provides such methods.

SUMMARY OF THE INVENTION

An integrated process for improved hydrocarbon recovery is disclosed. The process involves isolating a methane-rich stream for use in hydrocarbon synthesis. The stream is derived from a well gas from a natural gas source. The well gas may also include ethane, an LPG stream (including mainly C3–C5 hydrocarbons) and optionally a C5+ stream ("well gas condensate"). The methane-rich stream is isolated in a first separation zone, along with an LPG stream. Either prior to or following separation in the first separation zone, one or more of the streams may be treated in a hydroconversion reaction zone to remove sulfur compounds contained therein.

The methane-rich stream is converted to syngas and subjected to a hydrocarbon synthesis step, for example, a Fischer-Tropsch synthesis step. The products from the hydrocarbon synthesis step typically include a C1–C4 fraction, at least one low-boiling liquid fraction (generally in the C5–C20 range), and a high-boiling wax fraction (generally in the C20+ ). These fractions are isolated in a second separation zone. The C4– fraction from the synthesis step is combined with the well gas for recovery of LPG and a methane-rich stream (for production of syngas).

The low-boiling liquid fraction and the high-boiling wax fraction are preferably subjected (either separately or in combination) to additional process steps, for example hydrotreatment, hydroisomerization, hydrocracking (particularly in the case of the wax fraction), and the like (hereafter referred to as hydroconversion). The products of the additional process steps are sent to a third separation zone, and yield compositions useful, for example, in fuel-related products (preferably C5–C20 hydrocarbons) and an additional C4– fraction. The additional C1–C4 fraction can also be sent to the first separation zone and treated in an analogous fashion to the C1–C4 fraction from the hydrocarbon synthesis.

In one embodiment, a mixed LPG fraction is recovered from the first separation zone. In a separate embodiment, individual ethane, propane, and butane streams are isolated rather than the mixed LPG fraction. In this embodiment, the first separation zone preferably uses a demethanizer to isolate methane, a de-ethanizer to isolate ethane, and a de-propanizer to isolate propane and butanes.

DETAILED DESCRIPTION OF THE INVENTION

Figure 1:
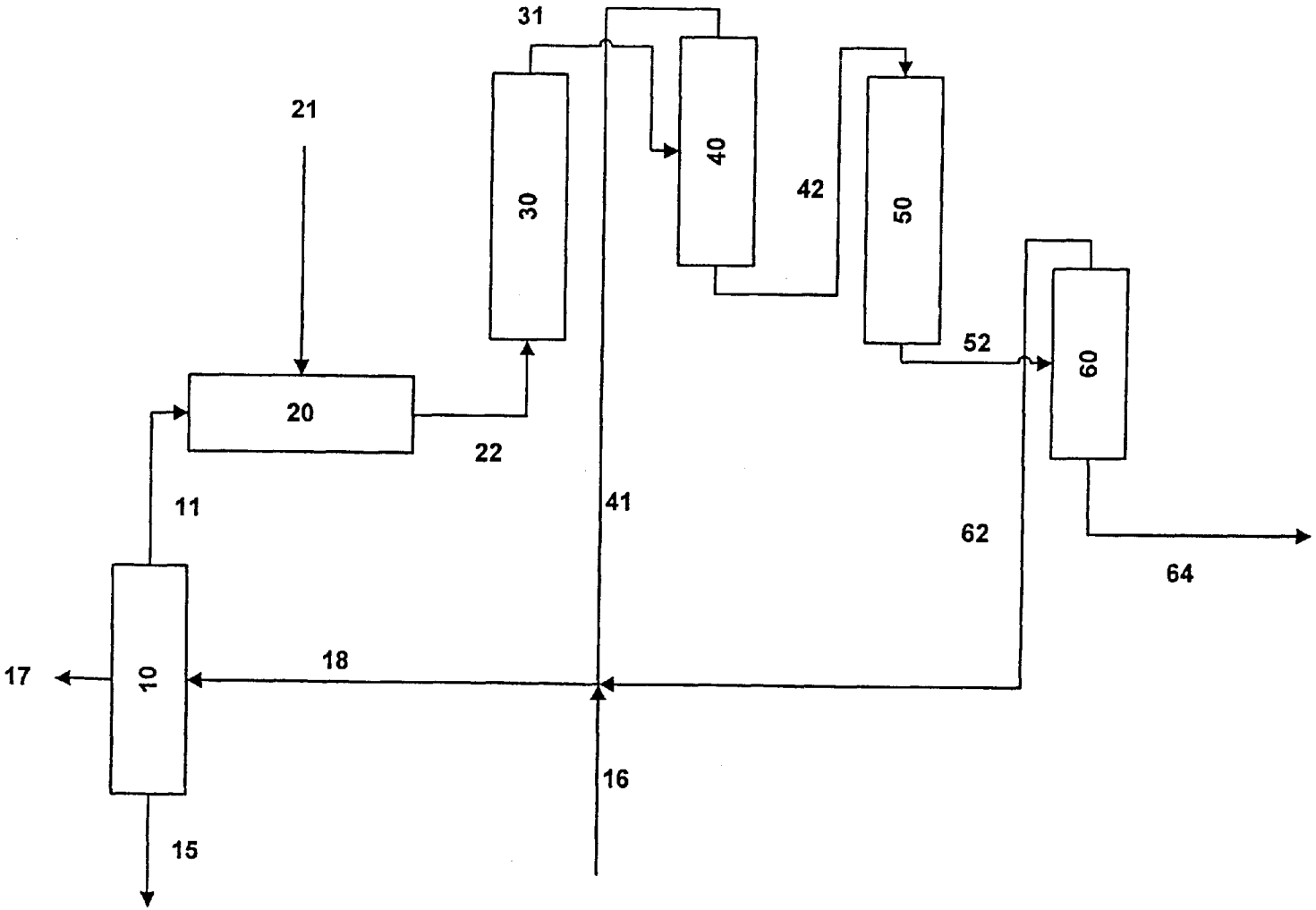
FIG. 1 is a schematic illustration of one embodiment of the process described herein.

An integrated process for improved hydrocarbon recovery is disclosed. In this process, a methane-rich fraction and preferably an LPG fraction is isolated from well gas. The methane is converted to syngas and then subjected to hydrocarbon synthesis conditions, preferably Fischer-Tropsch synthesis. A C4– fraction from the hydrocarbon synthesis can be used to generate additional methane for conversion to syngas and ultimately to higher molecular weight hydrocarbons, and also optionally to generate an additional LPG fraction. One or more liquid fractions from the hydrocarbon synthesis are then preferably subjected to hydroconversion conditions to yield compositions useful in fuel products and an additional C1–C4 fraction. The additional C1–C4 fraction can also be sent to the first separation zone and treated in an analogous fashion to the C1–C4 fraction from the hydrocarbon synthesis.

The process described herein is an integrated process. As used herein, the term "integrated process" refers to a process which involves a sequence of steps, some of which may be parallel to other steps in the process, but which are interrelated or somehow dependent upon either earlier or later steps in the total process.

An advantage of the present process is the effectiveness and relatively inexpensive processing costs with which the present process may be used to prepare high quality LPG with a minimum of heteroatom impurities. In particular, an advantage is that feedstocks that are not conventionally recognized as suitable sources for such product streams can be used. Another advantage is that C4– hydrocarbons from all stages in the process can be separated in one separation zone, and optionally but preferably can be desulfurized in one desulfurization zone.

The LPG fractions preferably include mostly C3–5 hydrocarbons, and more preferably include mostly propane, n-butane and iso-butane. They may also contain small amounts of pentanes and, less preferably, C3–5 olefins. The LPG formed in the present process is suitable for all possible end uses, for example, as an alternative fuel source for automobiles. Most preferably, the composition falls within the stringent specifications for LPG product streams in the area of alternative fuels.

In a preferred LPG product, the amount of ethane is less than about five percent by volume of the mixture, propylene is less than about one percent by volume of propane, and butylene is less than about one percent by volume of iso-butane. C5+ hydrocarbons are preferably less than about twenty five percent by volume of the mixture. The sulfur content is preferably less than about 150 ppm.

As discussed in detail below, LPG fractions are obtained from natural gas, from hydrocarbon synthesis (preferably Fischer-Tropsch synthesis), and/or from product streams resulting from the hydroconversion of the hydrocarbon synthesis. Methane-rich and LPG fractions may also be obtained from other sources, alone or in combination with methane-rich and LPG fractions from natural gas, hydrocarbon synthesis or hydroconversion of hydrocarbon synthesis products.

In one embodiment, individual C2, C3 and C4 streams are isolated. This can be accomplished, for example, by passing a mixture including C4– hydrocarbons through a de-methanizer, de-ethanizer and a de-propanizer.

In addition to methane, natural gas includes some heavier hydrocarbons (mostly C2–5 paraffins) and other impurities, e.g., mercaptans and other sulfur-containing compounds, carbon dioxide, nitrogen, helium, water and non-hydrocarbon acid gases. Natural gas fields also typically contain a significant amount of C5+ material (known as a "natural gas condensate"), which is liquid at ambient conditions. Methane-rich and, preferably, LPG fractions are isolated from the natural gas.

Methods for removing methane from C2+ hydrocarbons are well known to those of skill in the art. Suitable methods include absorption, refrigerated absorption, adsorption and condensation at cryogenic temperatures down to about −175° F. Demethanizer columns, which include one or more distillation towers, are typically used to separate methane and other more volatile components from ethane and less volatile components. De-methanizers are described, for example, in U.S. Pat. No. 5,960,643 to Kuechler et al. and C. Collins, R. J. J. Chen and D. G. Elliot, "Trends in NGL Recovery for Natural and Associated Gases", GasTech, Ltd. of Rickmansworth, England, pages 287–303, GasTech LNG/LPG Conference 84.

Although feedstocks including both methane and ethane can be used to generate syngas, less coking is observed when methane alone is used. For this reason, the majority of the ethane in the feedstock is preferably removed from the methane-rich fraction before the syngas is generated. The ethane is also preferably not present to a significant extent in the LPG fractions (preferably less than five percent by volume). The ethane can be removed, for example, using de-ethanizer columns.

After the methane-rich fraction is isolated and the bulk of the ethane removed, an LPG fraction is preferably isolated from the remaining C3+ product stream. Propane, n-butane and iso-butane can be isolated, for example, in a turbo-expander, and desulfurized to provide an LPG fraction. Alternatively, the propane and butanes can be separated using a de-propanizer. The remaining products are primarily C5+ hydrocarbons, which can be treated to remove sulfur and used, for example, in gasoline compositions.

In another embodiment, C4– hydrocarbons are separated from the C5+ hydrocarbons using other known techniques, for example, via solvent extraction or via adsorption using an adsorbent such as FLEXSORB®. The order in which de-methanization, de-ethanization and depropanization occur can vary, so long as a methane-rich feed suitable for use in a syngas generator and, preferably, a suitable LPG product are obtained.

Other feedstreams from various petroleum refining operations, including the distillation and/or cracking of crude oil, also provide a fraction containing C1–C5 paraffins. For example, cracked gas feedstreams include hydrogen and C1–C5 paraffins and refinery waste gas includes hydrogen and C1–C5 paraffins. Methane-rich streams suitable for syngas generation and/or LPG fractions can optionally be obtained from these streams as well, alone or in combination with natural gas streams, although natural gas alone is preferred. If methane and/or ethane from these streams is sent to the syngas generator, any olefins, alkynes, C3+ paraffins and/or heteroatom-containing compounds should be removed. Olefin and alkyne impurities are likely to be present in gas streams from refinery or petrochemical plants, as well as from C4– fractions from the hydrocarbon synthesis, and can be removed, for example, by hydrogenation. Sulfur impurities can be removed using means well known to those of skill in the art, for example extractive Merox, hydrotreating, adsorption, etc. Nitrogen-containing impurities can also be removed using means well known to those of skill in the art. Hydrotreating is the preferred means for removing these and other impurities.

The LPG fraction can be treated in a similar manner to remove olefin, alkyne and heteroatom impurities. Preferably, sulfur is removed in a single desulfurization stage.

Methane (and/or ethane and heavier hydrocarbons) can be desulfurized and sent through a conventional syngas generator to provide synthesis gas. Typically, synthesis gas contains hydrogen and carbon monoxide, and may include minor amounts of carbon dioxide, water, unconverted hydrocarbons and various other impurities.

The presence of sulfur, nitrogen, halogen, selenium, phosphorus and arsenic contaminants in the syngas is undesirable. For this reason, it is preferred to remove sulfur and other contaminants from the feed before performing the Fischer-Tropsch chemistry or other hydrocarbon synthesis. Means for removing these contaminants are well known to those of skill in the art. For example, ZnO guard beds are preferred for removing sulfur impurities. Means for removing other contaminants are well known to those of skill in the art.

Fischer-Tropsch synthesis is a preferred hydrocarbon synthesis, although other hydrocarbon syntheses, for example, conversion of syngas to methanol and subsequent conversion of methanol to higher molecular weight products can also be used.

In the Fischer-Tropsch synthesis process, liquid and gaseous hydrocarbons are formed by contacting a synthesis gas (syngas) comprising a mixture of H2 and CO with a Fischer-Tropsch catalyst under suitable temperature and pressure reactive conditions. The Fischer-Tropsch reaction is typically conducted at temperatures of about from 300° to 700° F. (149° to 371° C.) preferably about from 400° to 550° F. (204° to 228° C.); pressures of about from 10 to 600 psia, (0.7 to 41 bars) preferably 30 to 300 psia, (2 to 21 bars) and catalyst space velocities of about from 100 to 10,000 cc/g/hr., preferably 300 to 3,000 cc/g/hr.

The products may range from C1 to C200+ with a majority in the C5–C100 range. The reaction can be conducted in a variety of reactor types for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of H2 and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP0609079, also completed incorporated herein by reference for all purposes.

Suitable Fischer-Tropsch catalysts comprise on or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as ThO2, La2O3, MgO, and TiO2, promoters such as ZrO2, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but nonlimiting examples may be found, for example, in U.S. Pat. No. 4,568,663.

When the Fischer-Tropsch reaction is carried out in a slurry bed reactor, the products generally include a gaseous reaction product and one or more liquid reaction product. The gaseous reaction product generally comprises C4– products. A low-boiling liquid product includes hydrocarbons boiling below about 650° F. (e.g., C–650° F.). A high boiling wax fraction includes hydrocarbons boiling above about 650° F., and often up to boiling point temperatures of 1300° F. and above. The fraction boiling above about 650° F. (the wax fraction) contains primarily linear paraffins in the C20 to C200 range.

One or more of the liquid products recovered from a Fischer-Tropsch process may be separated using, for example, a high pressure and/or lower temperature vapor-liquid separator or low pressure separators or a combination of separators.

The tail gas fraction (including C4– hydrocarbons) is preferably sent to the first separation zone to obtain an additional methane-rich fraction for recycle through the syngas generator and/or an additional LPG fraction. The tail gas fraction may contain a significant amount of olefins. When the specifications for LPG requires low olefin concentration, hydrogenation of the tail gas fraction, or an LPG fraction derived therefrom may be necessary. This hydrogenation can occur before the fraction is sent to the first separation zone, or after passage through the first separation zone.

The relative amounts of the tail gas fraction, low-boiling liquid fraction and high-boiling wax fraction formed in the Fischer-Tropsch synthesis step can be controlled by judicious selection of catalysts and reaction conditions. Catalysts with low chain growth probabilities (for example, an alpha value below about 0.6) favor formation of relatively low molecular weight products, for example, C2–8 products, but tend to produce a relatively large amount of methane. The yield in C3–5 hydrocarbons suitable for use in preparing LPG fractions may be relatively high, but the chemistry may be less preferred because of the relatively high amount of methane formed, which must be recycled.

Catalysts with relatively high chain growth probabilities (for example, an alpha value above about 0.8) favor formation of wax and other heavy products, and tend to form relatively low amounts of methane. The wax can be treated, for example, by hydrocracking, to provide a variety of products, including hydrocarbons, useful for forming LPG fractions as well as hydrocarbons in the distillate fuel range. Selection of an appropriate set of conditions for performing the Fischer-Tropsch reaction depends in large part on market conditions, and these conditions can be adjusted, as appropriate, to provide a suitable product stream for hydroconversion to form useful commercial products.

At least a portion of the liquid fractions from the Fischer-Tropsch reaction are subjected to hydroconversion reactions. The low-boiling liquid fraction includes mostly linear hydrocarbons, and may be subjected to isomerization conditions to improve the pour point. Further, the fraction may include a significant amount of olefins, which may be hydrogenated via hydrotreatment conditions. The high-boiling wax fraction, which is highly paraffinic, may be subjected to hydrocracking conditions in order to isomerize and crack the wax to produce high quality fuel products. The C4– fraction can be sent through the first separation zone to provide an additional methane-rich and/or LPG fraction. The relative amounts of C4– products to fuel products is generally determined, for example, by the choice of catalyst used for hydroconversion and the hydroconversion reaction conditions. A more selective catalyst generally produces a higher proportion of fuel products, as does milder reaction conditions.

As used herein, the term "hydrotreating" is given its conventional meaning and describes processes that are well known to those skilled in the art. Hydrotreating refers to a catalytic process, usually carried out in the presence of free hydrogen, in which the primary purpose is the desulfurization and/or denitrification of the feedstock. In addition, oxygen is removed from oxygen-containing hydrocarbons (e.g., alcohols, acids, etc.). The sulfur is generally converted to hydrogen sulfide, the nitrogen is generally converted to ammonia, and the oxygen is converted to water, and these can be removed from the product stream using means well known to those of skill in the art. Although sulfur impurities are typically not present in Fischer-Tropsch products, they can be introduced when the products are contacted with pre-sulfided catalysts.

Generally, in hydrotreating operations, cracking of the hydrocarbon molecules, i.e., breaking the larger hydrocarbon molecules into smaller hydrocarbon molecules, is minimized and unsaturated hydrocarbons are either fully or partially hydrogenated.

Catalysts used in carrying out hydrotreating operations are well known in the art. See, for example, U.S. Pat. Nos. 4,347,121 and 4,810,357 for general descriptions of hydrotreating and typical catalysts used hydrotreating processes.

Suitable catalysts include noble metals from Group VIIIA, such as platinum or palladium on an alumina or siliceous matrix, and Group VIIIA and Group VIB metals, such as nickel-molybdenum or nickel-tin on an alumina or siliceous matrix. U.S. Pat. No. 3,852,207 describes a suitable noble metal catalyst and reaction conditions. Other suitable catalysts are described, for example, in U.S. Pat. Nos. 4,157,294 and 3,904,513. Non-noble metals (such as nickel-molybdenum) are usually present in the final catalyst composition as oxides, or possibly as sulfides, when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts include in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e., molybdenum and tungsten can be combined with the refractory oxide by impregnation, co-mulling or co-precipitation.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so-called ultra stable zeolite Y and high structural silica:alumina ratio zeolite Y such as that described in U.S. Pat. Nos. 4,401,556, 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate, and the various ELAPO molecular sieves described in U.S. Pat. No. 4,913,799 and the references cited therein. Details regarding the preparation of various non-zeolite molecular sieves can be found in U.S. Pat. Nos. 5,114,563 (SAPO); 4,913,799 and the various references cited in U.S. Pat. No. 4,913,799. Mesoporous molecular sieves can also be used, for example the M41S family of materials (J. Am. Chem. Soc. 1992, 114, 10834–10843), MCM-41 (U.S. Pat. Nos. 5,246,689, 5,198,203 and 5,334,368), and MCM-48 (Kresge et al., Nature 359:710 (1992)).

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

Furthermore, more than one catalyst type may be used in the reactor. The different catalyst types can be separated into layers or mixed. Typical hydrotreating conditions vary over a wide range. In general, the overall LHSV is about 0.25 to 20, preferably about 0.5 to 10. The hydrogen partial pressure is greater than 200 psia, preferably ranging from about 500 psia to about 2000 psia. Hydrogen recirculation rates are typically greater than 50 SCF/Bbl, and are preferably between 300 and 6000 SCF/Bbl. Temperatures range from about 300° F. to about 750° F., preferably ranging from 400° F. to 750° F.

The contents of each of the patents and publications referred to above are hereby incorporated by reference in its entirety.

Typical hydroisomerization conditions are well known in the literature and can vary widely. Isomerization processes are typically carried out at a temperature between 200° F. and 800° F., preferably 400° F. to 750° F., with a liquid hourly space velocity between 0.1 and 5, preferably between 0.25 and 2.50. Hydrogen is employed such that the mole ratio of hydrogen to hydrocarbon is between 1:1 and 20:1. Catalysts useful for isomerization processes are generally bifunctional catalysts that include a dehydrogenation/hydrogenation component, an acidic component, and optionally, but preferably, a hydrocracking suppressant.

The hydroisomerization catalyst(s) can be prepared using well known methods, e.g., impregnation with an aqueous salt, incipient wetness technique, followed by drying at about 125–150° C. for 1–24 hours, calcination at about 300–500° C. for about 1–6 hours, reduction by treatment with a hydrogen or a hydrogen-containing gas, and, if desired, sulfiding by treatment with a sulfur-containing gas, e.g., H2S at elevated temperatures. The catalyst will then have about 0.01 to 10 wt % sulfur. The metals can be composited or added to the catalyst either serially, in any order, or by co-impregnation of two or more metals. Additional details regarding preferred components of the hydroisomerization catalysts are described below.

The dehydrogenation/ hydrogenation component is preferably a Group VIII metal, more preferably a Group VIII non-noble metal, or a Group VI metal. Preferred metals include nickel, platinum, palladium, cobalt and mixtures thereof. The Group VIII metal is usually present in catalytically effective amounts, that is, ranging from 0.5 to 20 wt %. Preferably, a Group VI metal is incorporated into the catalyst, e.g., molybdenum, in amounts of about 1–20 wt %.

Examples of suitable acid components include crystalline zeolites, catalyst supports such as halogenated alumina components or silica-alumina components, and amorphous metal oxides. Such paraffin isomerization catalysts are well known in the art. The acid component may be a catalyst support with which the catalytic metal or metals are composited. Preferably, the acidic component is a zeolite or a silica-alumina support, where the silica/alumina ratio (SAR) is less than 1 (wt./wt.).

Preferred supports include silica, alumina, silica-alumina, silica-alumina-phosphates, titania, zirconia, vanadia and other Group III, IV, V or VI oxides, as well as Y sieves, such as ultra stable Y sieves. Preferred supports include alumina and silica-alumina, more preferably silica-alumina where the silica concentration of the bulk support is less than about 50 wt %, preferably less than about 35 wt %, more preferably 15–30 wt %. When alumina is used as the support, small amounts of chlorine or fluorine may be incorporated into the support to provide the acid functionality.

A preferred supported catalyst has surface areas in the range of about 180–400 m2 /gm, preferably 230–350 m2 /gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

The preparation of preferred amorphous silica-alumina microspheres for use as supports is described in Ryland, Lloyd B., Tamele, M. W., and Wilson, J. N., "Cracking Catalysts," Catalysis; Volume VII, Ed. Paul H. Emmett, Reinhold Publishing Corporation, New York, 1960.

Hydrocracking refers to a catalytic process, usually carried out in the presence of free hydrogen over zeolites or other acidic catalysts at relatively high temperatures and/or pressures, in which the cracking of the larger hydrocarbon molecules is a primary purpose of the operation. Desulfurization and/or denitrification of the feed stock usually will also occur.

Catalysts used in carrying out hydrocracking operations are well known in the art, and it should not be necessary to describe them in detail here. See, for example, U.S. Pat. Nos. 4,347,121 and 4,810,357 for general descriptions of hydrotreating, hydrocracking, and typical catalysts used in each process.

The natural gas and the methane-rich and LPG fractions isolated from the natural gas, as well as the products of the hydroconversion reactions, can be upgraded to remove sulfur and other undesirable materials. Methods for removing sulfur impurities are well known to those of skill in the art, and include, for example, extractive Merox, hydrotreating, adsorption, etc. Nitrogen-containing impurities can also be removed using means well known to those of skill in the art. Hydrotreating is the preferred means for removing these and other impurities.

Preferably, any sulfur-containing compounds resulting from the hydroconversion of the Fischer-Tropsch products is treated along with the sulfur-containing compounds in the natural gas in one de-sulfurization zone. This eliminates the need for a second de-sulfurization zone, at least with respect to those sulfur-containing compounds present in the C4– fractions. The de-sulfurization zone can be scaled up as desired to accommodate the additional capacity.

Since most of the sulfur-containing compounds in the natural gas and hydroconversion products are relatively volatile, they will most likely be found in the C4– fractions.

Figure 2:
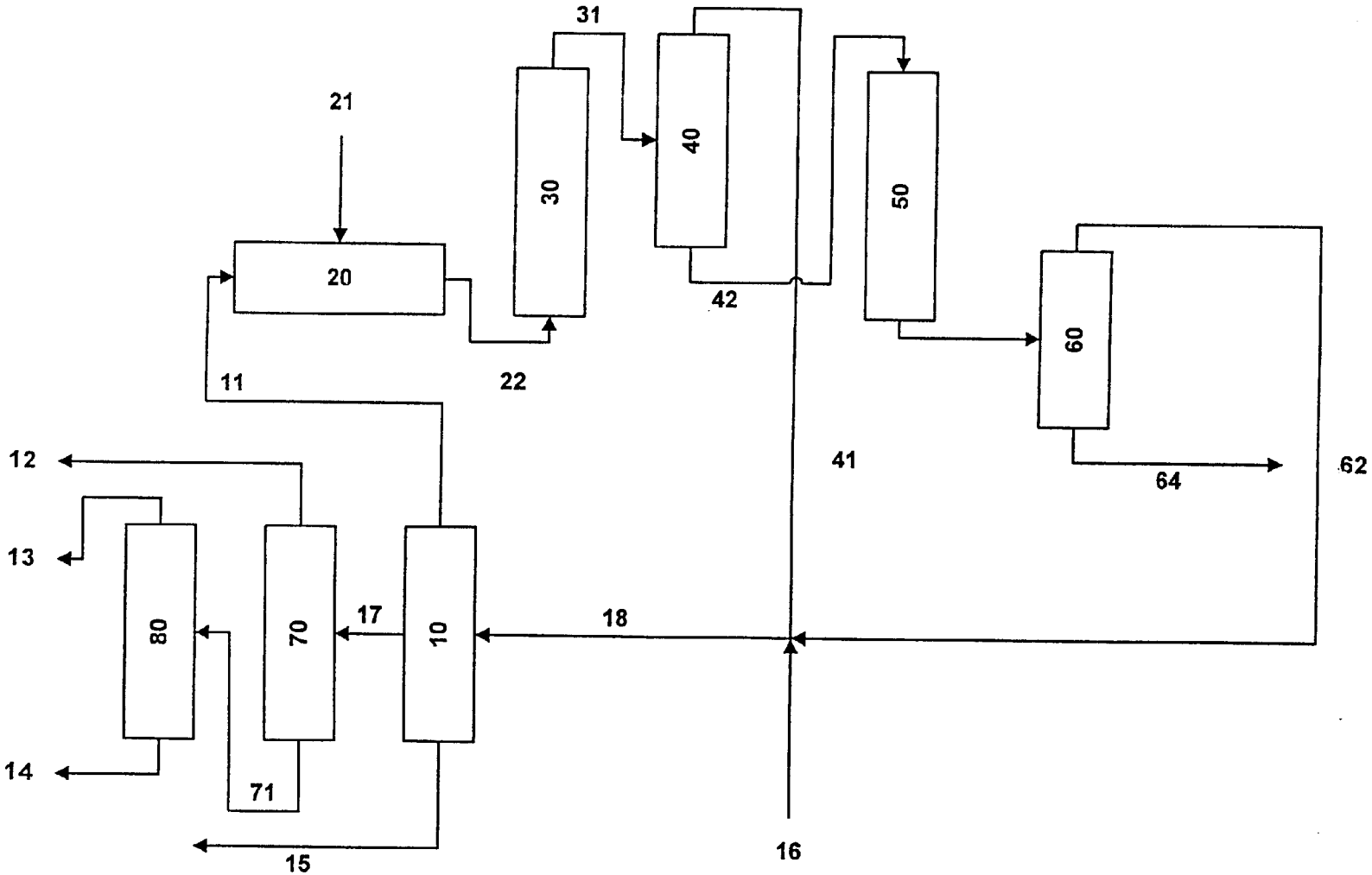
FIG. 2 is a schematic illustration of another embodiment of the process described herein.

The overall process is shown, for example, in FIGS. 1 and 2. In FIG. 1, well gas 16 is sent through a first separation zone 10 to provide a methane-rich stream 11, an LPG stream 17, and C5+ liquid products 15. The methane-rich stream 11 is sent through a syngas generator 20 to form syngas 22, which is sent to a Fischer-Tropsch reactor 30. The products 31 of the Fischer-Tropsch reaction are sent to a second separation zone 40 where the light product stream from the Fischer-Tropsch synthesis (predominantly C4– products) 41 are recycled to a blended stream 18 and through the first separation zone 10 and the C5+ products 42 are subjected to hydroconversion 50. The fuel product(s) 64 of the hydroconversion reaction is isolated in a third separation zone 60, and a light product stream from hydroconversion (predominantly C4– products) 62 are recycled to a blended stream 18 and through the first separation zone 10.

It is also possible to incorporate de-ethanizers, and de-propanizers, in order to isolate individual ethane, propane and butane fractions. This is shown, for example, in FIG. 2. In FIG. 2, well gas 16 is sent through a first separation zone 10 to provide a methane-rich stream 11, an LPG stream 17, and C5+ liquid products 15. The methane-rich stream 11 is sent through a syngas generator 20 to form syngas 22, which is sent to a Fischer-Tropsch reactor 30. The LPG stream 17 is sent through a de-ethanizer 70 to form a C2 stream 12 and a C3–C4 stream 71. The C3–C4 stream 71 is sent through a de-propanizer 80 to form a C3 stream 13 and a C4 stream 14. The products 31 of the Fischer-Tropsch reaction are sent to a second separation zone 40 where the C4– products 41 are recycled through the first separation zone 10 and ultimately through the de-ethanizer 70 and de-propanizer 80. CO2 and CO contained in stream 41 may be removed from this stream prior to separation in zone 10. The C5+ products 42 are subjected to hydroconversion 50. The single C5+ stream shown in FIG. 1 and in FIG. 2 is to be interpreted to represent at least one stream. The representation of stream 42 as being a C5+ stream takes the usual definition in the art as containing predominately C5+ molecules, with the proportion of C5+ being determined by the quality of the separation used in preparing the C5+ stream. Furthermore, stream 42 may be taken as representing more then one stream, each distinguished from the other by boiling point or boiling point range. Example multiple streams represented by stream 42 include a stream having a boiling point range which is generally below 650° F., and a second stream having a boiling point range which is generally equal to or above 650° F. The fuel product(s) 64 of the hydroconversion reaction is isolated in a third separation zone 60, and the C4– products 62 are recycled through the first separation zone 10 and ultimately through the deethanizer 70 and de-propanizer 80. As in the embodiment illustrated in FIG. 1, the fuel product will be one or more of naphtha, kerosene, jet fuel, middle distillate and diesel fuel. In FIGS. 1 and 2 either stream 41 or stream 62 or both are sent to separation zone 10. When not sent to zone 10, either stream 41 or stream 62 may be used elsewhere in the process, or piped outside the process for use elsewhere, or for sale or disposal.

In one embodiment, the C4– fractions from the Fischer-Tropsch synthesis and also from the hydroconversion reactions are combined and treated together, alone or in combination with the C4– fractions from the natural gas or other feedstreams.

While the present invention has been described with reference to specific embodiments, this application is intended to cover those various changes and substitutions that may be made by those skilled in the art without departing from the spirit and scope of the appended claims.

That which is claimed is:

1. A process for improved hydrocarbon recovery from a natural gas resource, the process comprising;

a) converting a methane-rich fraction to syngas;

b) subjecting the syngas to hydrocarbon synthesis and isolating therefrom at least one light product stream;

c) blending the light product stream and a well gas to form a blended stream; and d) separating the blended stream of step (c) in a separation zone and isolating the methane-rich fraction of step (a) and a light hydrocarbon fraction.

2. The process of claim 1, wherein the light product stream which is recovered from the hydrocarbon synthesis comprises a first methane-rich fraction and a first light hydrocarbon fraction.

3. The process of claim 1, wherein the well gas comprises a second methane-rich fraction and a second light hydrocarbon fraction.

4. The process of claim 1, further comprising isolating a predominantly C5+ hydrocarbon product from the hydrocarbon synthesis and subjecting the predominantly C5+ hydrocarbon product to hydroconversion conditions to produce the light product stream.

5. The process of claim 4, wherein a product from the hydrocarbon synthesis is separated in a second separation zone to produce a least the C5+ hydrocarbon product.

6. The process of claim 1, wherein the methane-rich and light hydrocarbon fractions are treated to remove sulfur-containing compounds.

7. The process of claim 1, wherein the light product stream contains a C4− hydrocarbon product isolated from the hydrocarbon synthesis.

8. The process of claim 7, wherein the light product stream comprises olefins and paraffins.

9. The process of claim 7, wherein the C4− hydrocarbon product from the hydrocarbon synthesis is treated to reduce at least a portion of the olefins to paraffins.

10. The process of claim 9, wherein the treatment occurs before passage through the separation zone.

11. The process of claim 9, wherein the treatment occurs after passage through the separation zone.

12. The process of claim 1, further comprising isolating a low-boiling liquid fraction and a high-boiling wax fraction from the hydrocarbon synthesis.

13. The process of claim 12, further comprising subjecting at least a portion of the low-boiling liquid and at last a portion of the high-boiling wax fractions to hydroconversion conditions.

14. The process of claim 13, wherein the hydroconversion conditions produce a C4− fraction.

15. The process of claim 14, wherein the C4− fraction is blended with the well gas prior to separation in the separation zone.

16. The process of claim 1, wherein the hydrocarbon synthesis is Fischer-Tropsch synthesis.

17. The process of claim 16, wherein the Fischer-Tropsch synthesis is performed using a catalyst with a relatively low chain growth probability.

18. The process of claim 16, wherein the Fischer-Tropsch synthesis is performed using a catalyst with a relatively high chain growth probability.

19. The process of claim 1, wherein a predominantly C2 stream is isolated from the light hydrocarbon fraction.

20. The process of claim 19, wherein a predominantly C3 stream is isolated from the light hydrocarbon fraction.

21. The process of claim 1, wherein a predominantly C3 stream is isolated from the light hydrocarbon fraction.

22. The process of claim 1, wherein the light product stream which is blended with the well gas comprises a C4− fraction selected from the group consisting of a C4− fraction from the hydrocarbon synthesis, a C4− fraction from the hydroconversion, or a mixture thereof.

23. The process of claim 1, wherein the blended stream is separated in a de-ethanizer and a de-propanizer, and a C2 stream, a C3 and a C4 stream isolated.

24. A process for preparing an LPG product stream, the process comprising:

isolating a first methane-rich fraction from well gas in a separation zone, converting the methane-rich fraction to syngas, subjecting the syngas to hydrocarbon synthesis conditions, isolating a $C_4$− fraction from the hydrocarbon synthesis and separating the $C_4$− fraction in the separation zone, blending the $C_4$− fraction and a well gas to form a blended stream, and separating the blended stream in the separation zone and isolating a methane-rich fraction and an LPG fraction.

25. The process of claim 24, further comprising: subjecting at least a portion of the products of the hydrocarbon synthesis to hydroconversion conditions to produce at least an additional $C_4$− fraction, and separating the $C_4$− fraction in the separation zone.

* * * * *